US005651406A

United States Patent [19]

Schaap

[11] Patent Number: 5,651,406

[45] Date of Patent: Jul. 29, 1997

[54] ROLLER SCREEN

[75] Inventor: Henk Schaap, Hilversum, Netherlands

[73] Assignee: Hamstra-Weesp B.V., Netherlands

[21] Appl. No.: 625,044

[22] Filed: Mar. 29, 1996

[30] Foreign Application Priority Data

Apr. 10, 1995 [NL] Netherlands ..... 1000095

[51] Int. Cl.[6] ..... A47G 5/02

[52] U.S. Cl. ..... 160/273.1

[58] Field of Search ..... 160/267.1, 266, 160/268.1, 269, 270, 271, 272, 273.1

[56] References Cited

U.S. PATENT DOCUMENTS

| | | | |
|---|---|---|---|
| 881,507 | 3/1908 | Wallen | 160/273.1 |
| 1,725,307 | 8/1929 | Sembower | 160/266 X |
| 2,132,986 | 10/1938 | Julien | 160/267.1 |
| 2,501,454 | 3/1950 | Schueren | 160/273.1 |
| 2,689,004 | 9/1954 | Van Der Horst | 160/269 |

FOREIGN PATENT DOCUMENTS

| | | |
|---|---|---|
| 455231 | 6/1968 | Switzerland . |

*Primary Examiner*—David M. Purol

*Attorney, Agent, or Firm*—Westman, Champlin & Kelly, P.A.

[57] ABSTRACT

A roller screen comprises a screen, a roller mechanism for the screen, a pull-beam connected to an end edge of the screen and two side guides for guiding the side edges of the screen. The screen extends into each side guide through a longitudinal slot. A guiding rod for the corresponding side edge of the screen is provided in each side guide. Each guiding rod is coupled with a restricted freedom of movement with a mounting element fixed in the end of the side guide opposite to the roller mechanism.

6 Claims, 2 Drawing Sheets

ROLLER SCREEN

BACKGROUND OF THE INVENTION

The invention relates to a roller screen, comprising a screen, a roller mechanism for the screen, a pull-beam connected to an end edge of the screen and two side guides for guiding the side edges of the screen, wherein the screen extends into each side guide through a longitudinal slot and a guiding rod for the corresponding side edge of the screen is provided in each side guide, wherein each guiding rod with its end opposite to the roller mechanism is received in a mounting element fixed in the corresponding end of the side guide.

Such a roller screen is known in various embodiments. In a known roller screen the end of the guiding rod opposite of the roller mechanism is bent along 90° and said end is inserted into an opening formed in the side guide. Thereby the known roller screen has the disadvantage that several operations are required for mounting the guiding rod, for example, a bending operation on the guiding rod and providing an opening in the side guide. Further the assembly of the guiding rod and the side guide is rather cumbersome. Moreover, the guiding rod may be released from its mounted position under some circumstances.

CH-A-455 231 discloses a roller screen of the above-mentioned type, wherein the mounting element is fixed in the side guide by a screw, by which said end of the guiding rod is also fixed in the mounting element. Thereby several operations with high accuracy are required for mounting the guiding rod and mounting the roller screen on the frame, otherwise an undesired high tension can easily occur in the screen. When the side guides are mounted inaccurately, a complete closing of the roller screen could be hindered.

It is an object of the invention to provide a roller screen of the above-mentioned type, wherein said disadvantages are obviated in an efficient manner.

SUMMARY OF THE INVENTION

The roller screen of the invention is characterized in that each guiding rod is coupled with a restricted freedom of movement with the mounting element.

In this manner a roller screen is obtained wherein bending operations on the guiding rod are not necessary, and where it is not necessary to provide openings in the side guide for mounting the corresponding guiding rod. The mounting element can easily be pressed into the open end of the side guide. Moreover, the guiding rod cannot be released from its mounted position unintentionally. Nevertheless, the guiding rod maintains sufficient freedom of movement to follow unimpededly the screen during opening or closing of the roller screen.

According to a preferred embodiment, each guiding rod has a widened part at said, a mounting end and the mounting element has a fork part cooperating with the widened part for movably enclosing the guiding rod in the side guide.

The invention further provides a mounting element to be used in the roller screen of the invention. The mounting element has a slot lateral to the longitudinal direction of the side guide, in which the widened part of the guiding rod can be accommodated with play and wherein the fork part engages the guiding rod with play above the slot.

BRIEF DESCRIPTION OF THE DRAWINGS

The invention will be further explained by reference to the drawings, in which an embodiment of the roller screen according to the invention is shown.

FIG. 2 is an enlarged sectional view of a side guide of the roller screen of FIG. 1 at.

DETAILED DESCRIPTION OF THE PREFERRED EMBODIMENT

Figure 1:
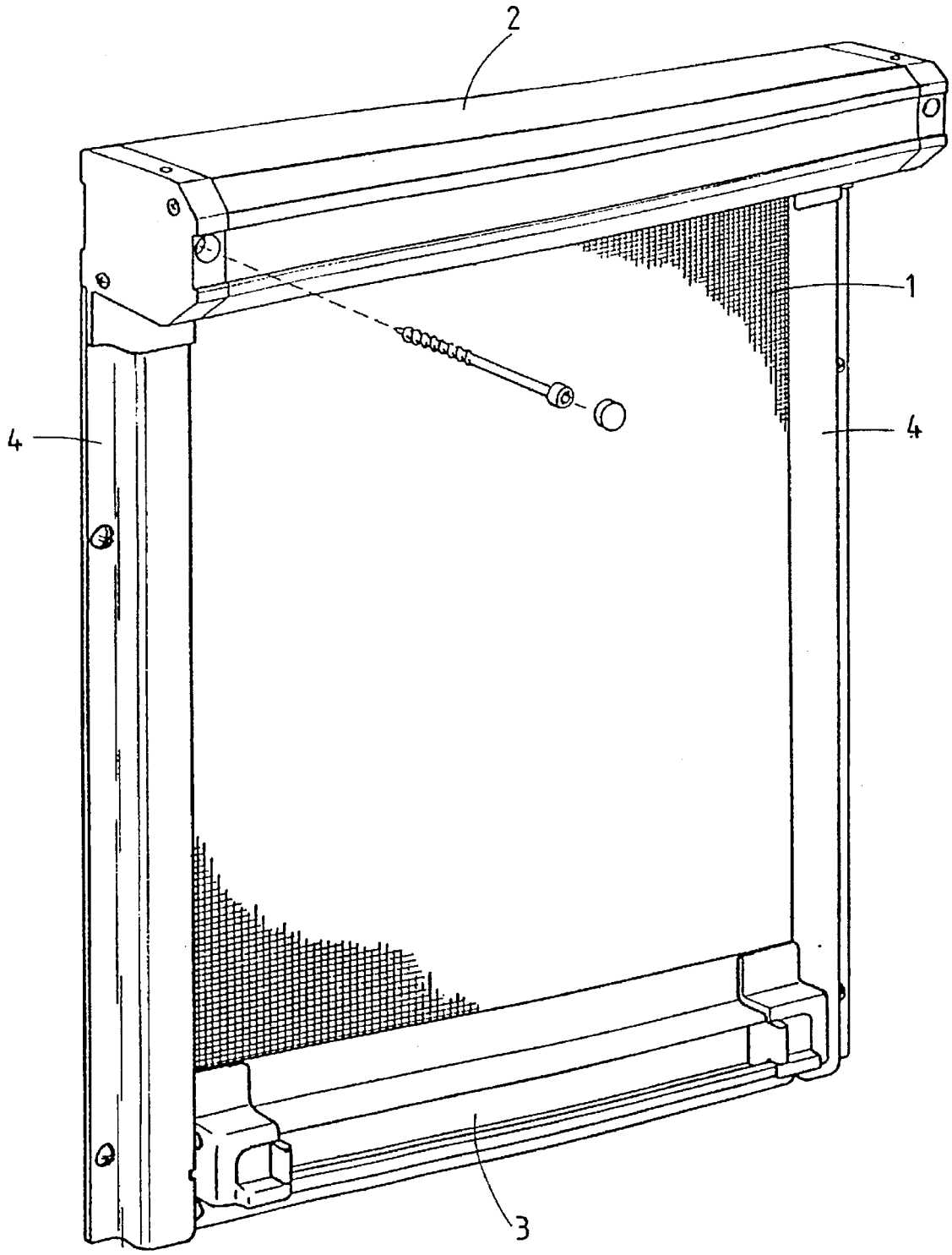
FIG. 1 shows a perspective view of an embodiment of the roller screen according to the invention.

FIG. 1 shows a perspective view of a roller screen provided with a screen 1, one end of which is attached to a roller mechanism in an usual manner. This roller mechanism is not shown in FIG. 1 as it is mounted within a housing 2. The other end of the screen 1 is connected to a pull-beam 3. Further the roller screen comprises two side guides 4, one on each side of the screen 1. The pull-beam 3 is guided in these side guides 4 in an usual manner, just as the corresponding side edges of the screen 1 which are generally provided with a hem for guiding the screen.

Figure 4:
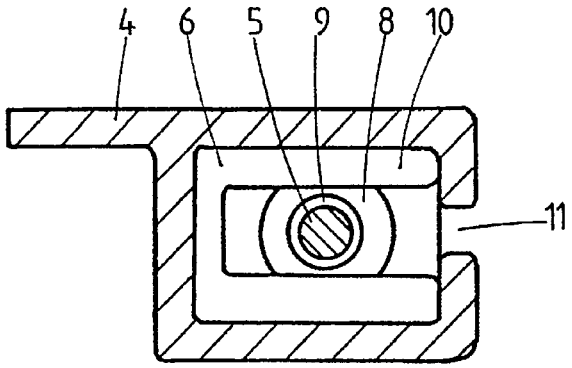
FIG. 4 is a cross-section of the side guide of FIG. 2 according to the line IV—IV.
Figure 2:
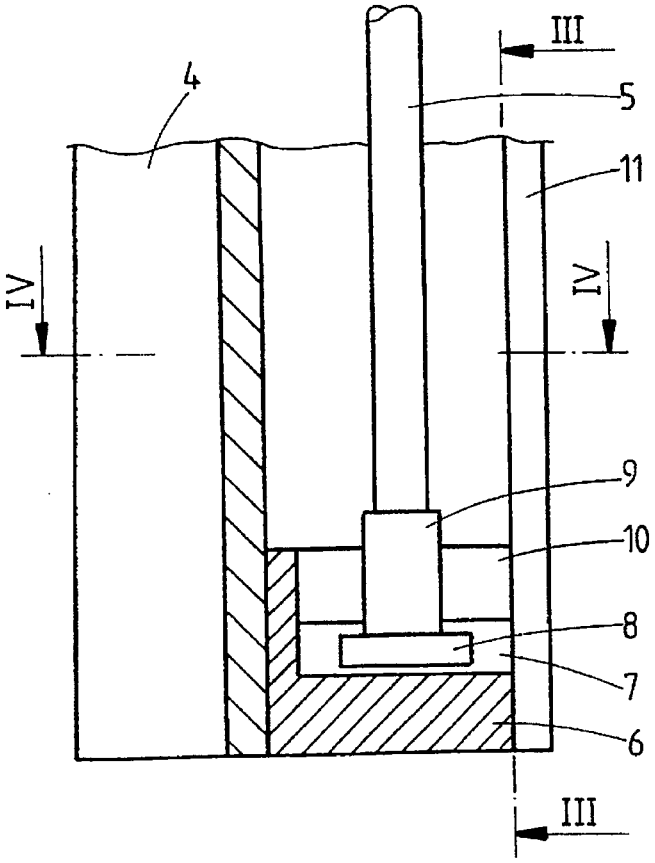
Figure 3:
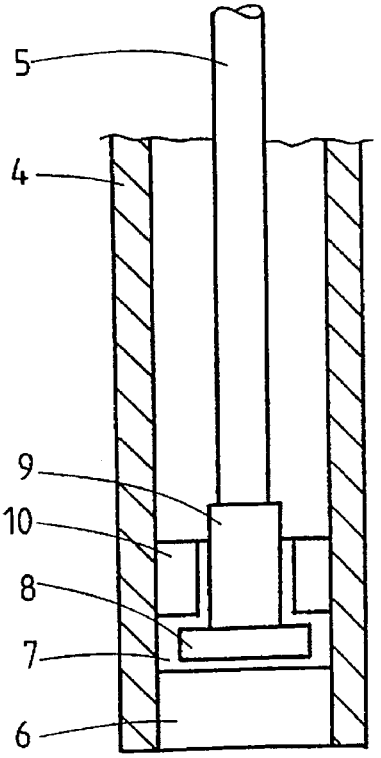
FIG. 3 is a cross-section according to the line III—III in FIG. 2.

In order to guide the screen 1 or the hem of the same, respectively, a guiding rod 5 is provided in each side guide 4, said guiding rod 5 being shown in FIGS. 2–4. Each guiding rod 5 is mounted in the corresponding side guide 4 by means of a mounting element 6 which is preferably made of plastic material. This mounting element 6 is received in the end of the side guide 4 opposite of the housing 2 with a clamping fit and is provided with a slot 7 lateral to the longitudinal direction of the side guide 4. An edge 8 of a bush 9 projecting circumferentially is accommodated with play in said slot 7, said bush 9 being clampingly fixed to the corresponding end of the guiding rod 5. A fork part 10 of the mounting element 6 is lying above the slot 7, said fork part 10 engaging with play around the bush 9 or the corresponding end of the guiding rod 5, respectively.

In this manner the guiding rod 5 is fully enclosed within the side guide 4, having nevertheless sufficient freedom of movement to make any desired movement required for the operation of the roller screen 1 in an unimpeded manner.

The screen 1 engages with the hem around the guiding rod 5 in a known manner not further shown. The screen 1 or the hem, respectively, projects into the side guide 4 through a slot 11 extending in the longitudinal direction of the side guide 4. However, it is also possible to couple the screen 1 with the guiding rods 5 in a different manner.

The roller screen described shows the advantage that no operations are required on the side guides 4 to provide mounting openings or the like for the corresponding guiding rod 5, whereas no further bending operations for the guiding rods 5 are required. The assembly of the roller screen is thereby relatively simple. The guiding rod 5 is fully enclosed within the side guide 4 while maintaining sufficient freedom of movement.

The invention is not restricted to the above-described embodiment which can be varied in a number of ways within the scope of the claims.

What is claimed is:

1. A roller screen, comprising:

a screen having an end edge and two side edges;

a roller mechanism for the screen;

a pull-beam connected to said end edge of the screen;

two side guides for guiding said side edges of the screen, said side guides each having a first end proximate the roller mechanism, a second end opposite said roller mechanism and a longitudinal slot extending between said first and second ends, wherein the screen extends into each of said side guides through the corresponding longitudinal slot;

two guiding rods for guiding the side edges of the screen, wherein a guiding rod is provided in each of said side guides and each guiding rod includes a widened end remote from the roller mechanism;

two mounting elements for retaining the widened ends of the guiding rods, wherein a mounting element is secured in each of said second ends of said side guides, and wherein each mounting element has a fork part cooperating with each corresponding widened end for movably enclosing the guiding rod in the side guide, said fork part having an open-ended slot opening to an inner surface of the corresponding side guide.

2. The roller screen according to claim 1, wherein each mounting element is provided with a second slot lateral to the longitudinal direction of the side guide, the widened end of the guiding rod being accommodated with play in said second slot, and wherein the fork part engages with play around the guiding rod above said second slot.

3. The roller screen according to claims 1, wherein each widened end includes a bush in which an end of the guiding rod is fixed, each bush having a flange edge projecting circumferentially.

4. The roller screen according to claim 2, wherein each widened end includes a bush in which an end of the guiding rod is fixed, each bush having a flange edge projecting circumferentially.

5. The roller screen according to claim 1, wherein each inner surface includes the corresponding longitudinal slot.

6. An apparatus for guiding a screen in a roller screen, the apparatus comprising:

a guide rod having an end wider than a rod portion; and a mounting element having a first slot opening to a first surface for receiving the end of the rod, and a second slot opening to a second surface and the first slot to form a fork part to retain the end in the first slot, wherein the rod portion extends through the second slot with the end positioned in the first slot.

* * * * *

UNITED STATES PATENT AND TRADEMARK OFFICE

CERTIFICATE OF CORRECTION

PATENT NO. : 5,651,406

DATED : July 29, 1997

INVENTOR(S) : Henk Schaap

It is certified that error appears in the above-indentified patent and that said Letters Patent is hereby corrected as shown below:

Column 4, line 1, replace "claims" with --claim--.

Signed and Sealed this

Twenty-first Day of October 1997

*Attest:*

*Attesting Officer*

BRUCE LEHMAN

*Commissioner of Patents and Trademarks*